US010373747B2

(12) United States Patent
Deligianni et al.

(10) Patent No.: US 10,373,747 B2
(45) Date of Patent: Aug. 6, 2019

(54) MAGNETIC INDUCTOR STACKS

(71) Applicant: INTERNATIONAL BUSINESS MACHINES CORPORATION, Armonk, NY (US)

(72) Inventors: Hariklia Deligianni, Alpine, NJ (US); Bruce B. Doris, Hartsdale, NY (US); Eugene J. O'Sullivan, Nyack, NY (US); Naigang Wang, Ossining, NY (US)

(73) Assignee: INTERNATIONAL BUSINESS MACHINES CORPORATION, Armonk, NY (US)

( * ) Notice: Subject to any disclaimer, the term of this patent is extended or adjusted under 35 U.S.C. 154(b) by 191 days.

(21) Appl. No.: 15/403,292

(22) Filed: Jan. 11, 2017

(65) Prior Publication Data

US 2018/0197670 A1 Jul. 12, 2018

(51) Int. Cl.

| | |
|---|---|
| ***H01F 5/00*** | (2006.01) |
| ***H01F 1/147*** | (2006.01) |
| ***H01F 17/00*** | (2006.01) |
| ***H01F 41/04*** | (2006.01) |

(52) U.S. Cl.

CPC ..... *H01F 1/14766* (2013.01); *H01F 1/14708* (2013.01); *H01F 17/0013* (2013.01); *H01F 41/046* (2013.01); *H01F 2017/0066* (2013.01)

(58) Field of Classification Search

CPC ..... H01L 23/5227; H01L 27/08; H01L 28/10
USPC ..... 336/200
See application file for complete search history.

(56) References Cited

U.S. PATENT DOCUMENTS 5,194,806 A * 3/1993 Obama ..... G01B 7/24 29/621.1
7,488,659 B2 * 2/2009 Dyer ..... H01L 21/823807 438/294
7,982,286 B2 * 7/2011 Rossi ..... H01L 21/32051 257/531
8,044,755 B2 * 10/2011 Smeys ..... H01F 17/0006 257/531
8,354,694 B2 * 1/2013 Bedell ..... H01L 21/823807 257/192

(Continued)

FOREIGN PATENT DOCUMENTS

CN 102529211 A 7/2012

OTHER PUBLICATIONS

Hariklia Deligianni, et al., Pending U.S. Appl. No. 15/800,702, entitled "Magnetic Inductor Stacks;" filed with the U.S. Patent and Trademark Office on Nov. 1, 2017.

(Continued)

*Primary Examiner* — Alexander Talpalatski
(74) *Attorney, Agent, or Firm* — Cantor Colburn LLP; Vazken Alexanian

(57) ABSTRACT

A magnetic laminating inductor structure and process for preventing substrate bowing and damping losses generally include a laminated film stack including a magnetic layer having a tensile stress, an insulating layer having a compressive stress disposed on the magnetic layer, and a dielectric planarizing layer on the insulating layer. The dielectric planarizing layer has a neutral stress and a roughness value less than the insulating layer. The reduction in surface roughness reduces damping losses and the compressive stress of the insulating layers reduces wafer bowing.

9 Claims, 4 Drawing Sheets

(56) References Cited

U.S. PATENT DOCUMENTS

| | | | | |
|---|---|---|---|---|
| 8,466,537 | B1 * | 6/2013 | Papou | H01L 23/5227 257/531 |
| 8,691,696 | B2 * | 4/2014 | Cai | H01L 21/311 257/211 |
| 9,231,072 | B2 * | 1/2016 | Alptekin | H01L 29/513 |
| 9,356,121 | B2 * | 5/2016 | Jagannathan | H01L 29/66545 |
| 9,437,668 | B1 * | 9/2016 | Deligianni | H01L 28/10 |
| 9,799,519 | B1 * | 10/2017 | Joseph | H01L 21/2633 |
| 2014/0349414 | A1 | 11/2014 | Zhong et al. | |
| 2017/0179154 | A1 * | 6/2017 | Furihata | H01L 27/11524 |

OTHER PUBLICATIONS

List of IBM Patents or Patent Applications Treated As Related; (Appendix P), Date Filed Nov. 1, 2017; 2 pages.

Deligianni et al., "Laminated Magnetic Inductor Stack With High Frequency Peak Quality Factor," U.S. Appl. No. 15/479,615, filed Apr. 5, 2017.

Deligianni et al., "Stress Management for Thick Magnetic Film Inductors," U.S. Appl. No. 15/599,754, filed May 19, 2017.

Deligianni et al., "Magnetic Inductor Stack Including Insulating Material Having Multiple Thicknesses," U.S. Appl. No. 15/584,766, filed May 2, 2017.

Deligianni et al., "Magnetic Inductor Stack Including Magnetic Materials Having Multiple Permeabilities," U.S. Appl. No. 15/494,871, filed Apr. 24, 2017.

Deligianni et al., "Magnetic Inductor Stack Including Magnetic Materials Having Multiple Permeabilities," U.S. Appl. No. 15/966,202, filed Apr. 30, 2018.

Deligianni et al., "Magnetic Inductor With Multiple Magnetic Layer Thicknesses," U.S. Appl. No. 15/473,725, filed Mar. 30, 2017.

Deligianni et al., "Magnetic Inductor With Shape Anisotrophy," U.S. Appl. No. 15/476,147, filed Mar. 31, 2017.

List of IBM Patents or Patent Applications Treated As Related; (Appendix P), Date Filed Jul. 5, 2018; 2 pages.

* cited by examiner

MAGNETIC INDUCTOR STACKS

BACKGROUND

The present invention relates to on-chip magnetic devices, and more specifically, to on-chip magnetic structures and methods for relieving stress and minimizing damping losses caused by surface roughness.

On-chip magnetic inductors are important passive elements with applications in fields such as on-chip power converters and radio frequency (RF) integrated circuits. In order to achieve high energy density, magnetic core materials with thickness ranging several 100 nm to a few microns are often implemented. For example, in order to achieve the high energy storage required for power management, on-chip inductors typically require relatively thick magnetic yoke materials (several microns or more), Inductor performance can benefit greatly by adding magnetic film stacks laminated with dielectrics. Two basic configurations are closed yoke and solenoid structure inductors. The closed yoke has copper wire with magnetic stack wrapped around it, and the solenoid inductor has magnetic stack with copper wire wrapped around it. Both inductor types benefit by having very thick magnetic materials.

SUMMARY

Exemplary embodiments include inductor structures and methods for forming the inductor structures. In one or more embodiments, the inductor structure includes one or more metal lines. A laminated film stack encloses the one or more metal lines and includes a magnetic layer having a tensile stress, an insulating layer having a compressive stress disposed on the magnetic layer, and a dielectric planarizing layer on the insulating layer. The dielectric planarizing layer has a neutral stress and a roughness value less than the insulating layer.

In one or more embodiments, the method of forming an inductor structure includes depositing alternating magnetic and insulating layers on a processed wafer. The magnetic layers have a tensile stress and the insulating layers have a compressive stress. A dielectric planarizing layer is periodically deposited on a selected one of the insulating layers to reduce a damping loss relative to an inductor structure without the dielectric planarizing layer.

In one or more other embodiments, the inductor structure includes a laminated film stack. The laminated film stack includes a magnetic layer having a tensile stress, an insulating layer having a compressive stress disposed on the magnetic layer, and a dielectric planarizing layer on the insulating layer. The dielectric planarizing layer has a neutral stress and a roughness value less than the insulating layer. One or more metal lines can be wrapped about the laminated film stack.

Additional features and advantages are realized through the techniques of the present invention. Other embodiments and aspects of the invention are described in detail herein and are considered a part of the claimed invention. For a better understanding of the invention with the advantages and the features, refer to the description and to the drawings.

BRIEF DESCRIPTION OF THE DRAWINGS

The subject matter which is regarded as the invention is particularly pointed out and distinctly claimed in the claims at the conclusion of the specification. The forgoing and other features, and advantages of the invention are apparent from the following detailed description taken in conjunction with the accompanying drawings in which:

Figure ("FIG.") 1 graphically illustrates deflection as a function of distance of a magnetic inductor structure without stress management.

DETAILED DESCRIPTION

Figure 1:
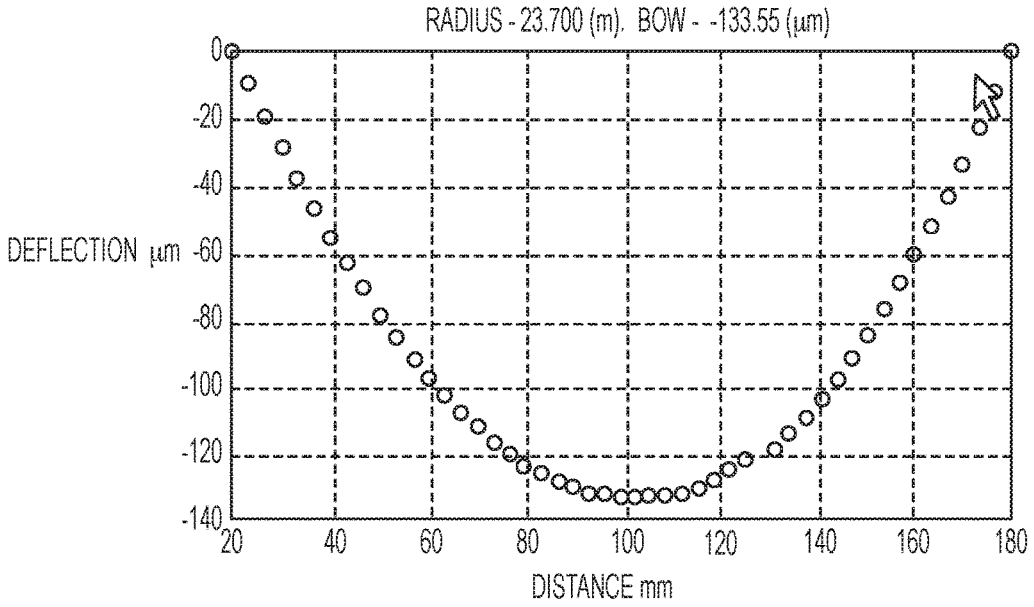

Detailed embodiments of the structures of the present invention are described herein. However, it is to be understood that the embodiments described herein are merely illustrative of the structures that can be embodied in various forms. In addition, each of the examples given in connection with the various embodiments of the invention is intended to be illustrative, and not restrictive. Further, the figures are not necessarily to scale, some features can be exaggerated to show details of particular components. Therefore, specific structural and functional details described herein are not to be interpreted as limiting, but merely as a representative basis for teaching one skilled in the art to variously employ the methods and structures of the present description. For the purposes of the description hereinafter, the terms "upper", "lower", "top", "bottom", "left," and "right," and derivatives thereof shall relate to the described structures, as they are oriented in the drawing figures. The same numbers in the various figures can refer to the same structural component or part thereof.

As used herein, the articles "a" and "an" preceding an element or component are intended to be nonrestrictive regarding the number of instances (i.e. occurrences) of the element or component. Therefore, "a" or "an" should be read to include one or at least one, and the singular word form of the element or component also includes the plural unless the number is obviously meant to be singular.

As used herein, the terms "invention" or "present invention" are non-limiting terms and not intended to refer to any single aspect of the particular invention but encompass all possible aspects as described in the specification and the claims.

As previously noted, closed yoke inductors and solenoid structure inductors benefit by having very thick magnetic materials. However, one well known issue with depositing thicker materials is the associated stress. Stress can cause wafers to bow and this bow can cause subsequent processing issues with lithography alignment and wafer chucking on processing tools. The magnitude of stress associated with a particular material as well as the type of stress, e.g., compressive or tensile, can be readily measured using known techniques, e.g., laser induced diffraction imaging methods. Stress for magnetic materials like CoFeB for example is typically tensile stress and can be about 200 to about 400 megapascals (MPa) in the tensile direction. Because the total magnetic film thickness requirement can be greater than 1 micrometer (μm), the wafer bow can be considerably high. To balance stress, a compressive dielectric oxide or nitride can be used as an insulating layer to help counteract the tensile stress of the magnetic materials.

FIG. 1 graphically illustrates wafer bow in terms of deflection across a typical wafer including a sputtered and laminated COFeB magnetic film deposited thereon at a cumulative thickness of 800 nanometers (nm) without compressive dielectric spacers between magnetic layers. Instead, neutral dielectric spacers were used. A conventional wafer bow measurement tool as is available in the industry was used to measure film stress across the wafer. Wafer bow in the tensile direction across the wafer was measured to be about 135 micrometers, which, as noted above, can cause issues with lithography alignment to complete the device as well as introducing wafer chucking issues.

In addition to wafer bow, magnetic loss is also an important issue for magnetic material stacks utilized in magnetic inductors. It has been discovered that surface roughness of the magnetic materials can lead to damping losses, which degrades overall inductor performance. For example, permeability data has shown that the ferromagnetic resonance (FMR) frequency peaks become broader and shorter as surface roughness increases, which directly translates to lower Q. Typically, the insulating layer is deposited at low temperatures and can have RMS (root mean square) calculated roughness of approximately 0.4 nm or higher, which gets multiplied as the number of insulating layers increases within the inductor film stack. Likewise, the RMS roughness of a typical amorphous magnetic material layer like CoFeB is around 0.23 nm. Although the RMS surface roughness for CoFeB and the dielectric spacer can be relatively smooth by themselves, the number of alternating film layers in the stack can be as high as 20 or more and the surface roughness associated with each layer is additive. Thus, after 10 or more layers, the RMS surface roughness can be 2.0 nm or higher and can have a profound negative effect on magnetic losses due to damping.

The present invention is generally directed to stress management processes and inductor structures that enable sufficient stress balancing so that the inductor stack can be processed without subsequent alignment issues in lithography or chucking problems on process tools, i.e., wafer bow is prevented. The stress management processes and inductor structures enables fabrication of inductors with a total thickness of the magnetic layers greater than 0.8 micrometers. At the same time, the present invention minimizes magnetic losses from damping by smoothening one or more of the dielectric surfaces between the magnetic layers within the inductor stack, which minimizes the surface roughness additive effect from multiple layers within the inductor stack.

Figure 2:
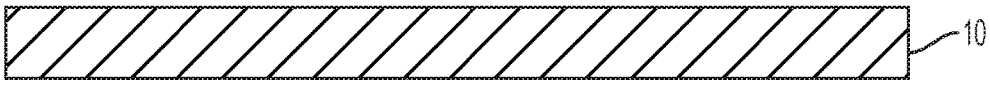
FIG. 2 depicts a cross sectional view of a processed wafer for fabricating an inductor structure in accordance with the present invention.

Referring now to FIG. 2, there is depicted a processed wafer 10 upon which the magnetic inductor can be fabricated. A "processed wafer" is herein defined as a wafer that has undergone semiconductor front end of line processing (FEOL) middle of the line processing (MOL), and back end of the line processing (BEOL), wherein the various desired devices and circuits have been formed.

The typical FEOL processes include wafer preparation, isolation, well formation, gate patterning, spacer, extension and source/drain implantation, silicide formation, and dual stress liner formation. The MOL is mainly gate contact formation, which is an increasingly challenging part of the whole fabrication flow, particularly for lithography patterning. The state-of-the-art semiconductor chips, the so called 14 nm node of Complementary Metal-Oxide-Semiconductor (CMOS) chips, in mass production features a second generation three dimensional (3D) FinFET, a metal one pitch of about 55 nm and copper (Cu)/low-k (and air-gap) interconnects. In the BEOL, the Cu/low-k interconnects are fabricated predominantly with a dual damascene process using plasma-enhanced CVD (PECVD) deposited interlayer dielectric (ILDs), PVD Cu barrier and electrochemically plated Cu wire materials.

Figure 3:
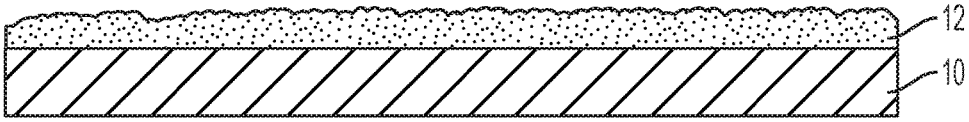
FIG. 3 depicts a cross sectional view of the processed wafer of FIG. 2 subsequent to deposition of an insulating layer thereon.

In FIG. 3, an insulating layer 12 is deposited onto the processed wafer 10. The insulating layer is not intended to be limited to any specific material and can include dielectric materials such as silicon dioxide ($SiO_2$), silicon nitride (SiN), silicon oxynitride ($SiO_xN_y$), magnesium oxide (MgO), aluminum oxide ($AlO_2$), or the like. The insulating layer 12 can be deposited using a deposition process including, but not limited to, PVD, CVD, PECVD, or any combination thereof. In one or more embodiments, the insulating layer and method of deposition is selected to provide the insulating layer with compressive stress, which can counteract the tensile stress associated with the magnetic layer.

The bulk resistivity and the eddy current loss of the magnetic structure can be controlled by the insulating layer because one function of the insulating layer is to isolate the magnetic materials from each other in the stack. The thickness of the insulating layer 12 is typically minimal and is generally at a thickness effective to electrically isolate the magnetic layer upon which it is disposed from other magnetic layers in the film stack. Generally, the insulating layer has a thickness of about 25 nanometers (nm) to about 100 nm and is about one half or more of the magnetic layer thickness.

The roughness from the top surface of the processed wafer 10 is translated to the top surface of the deposited insulating layer because the deposited insulating layer is highly conformal. The starting processed wafers utilized for inductor fabrication just prior to magnetic material fabrication typically have a RMS calculated surface roughness of about 0.5 nm. Additionally, as noted above, the surface roughness associated with each deposited layer is typically additive. Because of this additive effect, as more layers of insulating materials and magnetic materials are deposited to form the magnetic inductor stack (typically more than 20) the surface roughness increases. For example, the surface roughness of the dielectric material translates to the surface roughness of the magnetic material which causes damping losses, lower Q (ratio of its inductive reactance to its resistance at a given frequency), and degraded performance.

Figure 4:
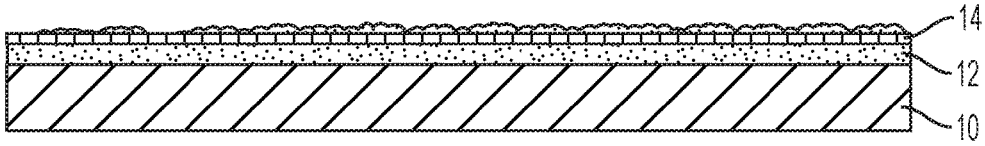
FIG. 4 depicts a cross sectional view of the processed wafer of FIG. 3 subsequent to deposition of a dielectric planarizing layer to reduce surface roughness of the insulating layer in accordance with one or more embodiments of the present invention.

In FIG. 4, a dielectric planarizing material 14 is deposited onto the insulating layer 12. The dielectric planarizing material 14 can be a spin-on dielectric material in a suitable solvent or a thermally flowable dielectric material that is selected to be neutral in terms of stress. Exemplary neutral dielectric planarizing materials include, but are not limited to, a silicate, a siloxane, a methyl silsesquioxane (MSQ), a hydrogen silsesquioxane (HSQ), an MSQ/HSQ, a perhydrosilazane (TCPS), a polysilazane, phosphosilicates or the like. By way of example, the planarizing dielectric material can be a thermally flowable material such as tetraethyl orthosilicate (TEOS).

The dielectric planarizing material 14 can be deposited using a deposition process including, but not limited to, PVD, CVD, PECVD, or any combination thereof. The thickness of the neutral dielectric planarizing layer 14 is about 1 to 50 nm and fills at least a portion of the valleys of the underlying dielectric layer 12 so as to decrease the surface roughness associated with the underlying insulating layer 12. In one or more embodiments, the thickness of the neutral dielectric planarizing layer is equal to or greater than the average peak to valley differential of the underlying insulating layer 12.

The dielectric planarizing material 14 reduces the surface roughness relative to the underlying insulating layer 12. In one or more embodiments, the dielectric planarizing material provides a surface roughness of less than 1.0 nm. In one or more other embodiments, the dielectric planarizing material provides a surface roughness of less than 0.5 nm, and in still in one or more embodiments, the dielectric planarizing material provides a surface roughness of less than 0.2 nm. By way of example, RMS roughness of an insulating layer prior to deposition of the dielectric planarizing layer was 2.5 nm. After deposition of TEOS at a thickness of 30 nm, the RMS surface roughness was measured to be about 0.6 to 0.7 nm. Further optimization can be expected to further reduce the surface roughness.

Figure 5:
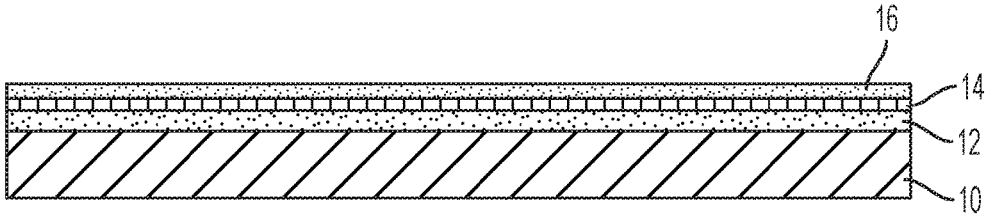
FIG. 5 depicts a cross sectional view of the processed wafer of FIG. 4 subsequent to deposition of a magnetic layer onto the dielectric planarizing layer in accordance with one or more embodiments of the present invention.

In FIG. 5, a magnetic layer 16 is deposited onto the dielectric planarizing material 14 and the insulating layer 12. The magnetic layer is not intended to be limited to any specific material and can include CoFe, CoFeB, CoZrTi, CoZrTa, CoZr, CoZrNb, CoZrMo, CoTi, CoNb, CoHf, CoW, FeCoN, FeCoAlN, CoP, FeCoP, CoPW, CoBW, CoPBW, FeTaN, FeCoBSi, FeNi, CoFeHfO, CoFeSiO, CoZrO, CoFeAlO, combinations thereof, or the like. Inductor core structures from these materials have generally been shown to have low eddy losses, high magnetic permeability, and high saturation flux density and can be deposited at relatively low temperatures without damaging the underlying devices in the processed wafer 10.

Each of the magnetic layers 16 in the laminate stack can have a thickness of about 50 nm to about 400 nm and typically has a tensile stress value of about 50 to about 400 MPa. In one or more other embodiments, the thickness of each magnetic layer can be within a range of 100 nm to 200 nm. Tensile stress is a type of stress in which the two sections of material on either side of a stress plane tend to pull apart or elongate. In contrast, compressive stress is the reverse of tensile stress, wherein adjacent parts of the material tend to press against each other through a typical stress plane.

Each magnetic layer 16 can be deposited through vacuum deposition technologies (i.e., sputtering PVD—physical vapor deposition) or electrodepositing through an aqueous solution. Vacuum methods have the ability to deposit a large variety of magnetic materials and to easily produce laminated structures. However, they usually have low deposition rates, poor conformal coverage, and the derived magnetic films are typically difficult to pattern. Electroplating has been a standard technique for the deposition of thick metal films due to its high deposition rate, conformal coverage and low cost.

Figure 6:
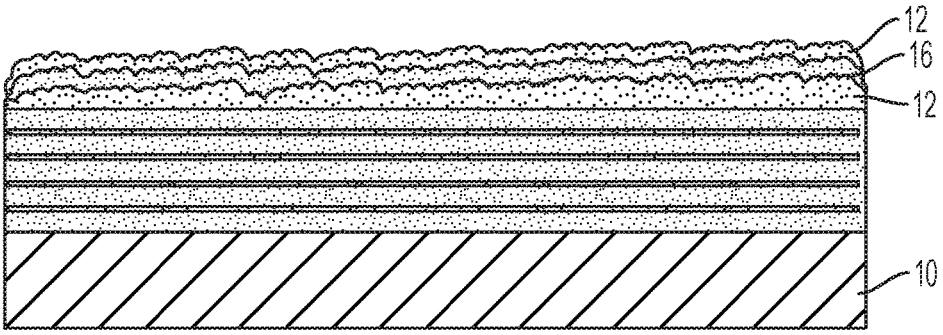
FIG. 6 depicts a cross sectional view of the processed wafer including alternating insulating an magnetic layers deposited onto a processed wafer in accordance with one or more embodiments of the present invention.

Referring now to FIG. 6, the process is repeated to form alternating layers of insulating material 12 and magnetic material 16. After several layers of deposition, the cumulative roughness from each layer of insulating material 12 and magnetic material 16 adds up and the additive surface roughness can be reduced by periodic deposition of the dielectric planarizing layer 14. For example, if each of the magnetic layers 16 has a RMS calculated surface roughness of about 0.2 nm and each of the insulating layers 12 has a RMS calculated surface roughness of about 0.2 nm, the cumulative RMS surface roughness after deposition of about 10 layers is about 2.0 nm, which is fairly significant and can have a negative affect that leads to significant magnetic loss in the form of damping.

Figure 7:
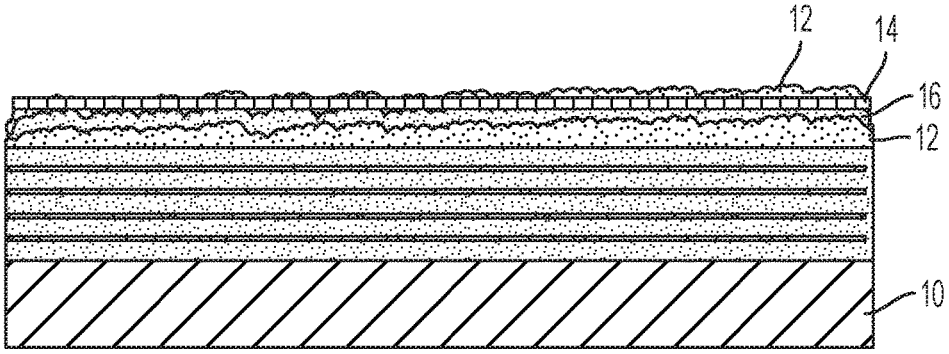
FIG. 7 depicts a cross sectional view of the processed wafer of FIG. 6 subsequent to deposition of a dielectric planarizing layer to reduce surface roughness of the uppermost insulating layer in accordance with one or more embodiments of the present invention.

In order to minimize these types of damping losses, the dielectric planarizing material 14 is deposited onto the insulating layer 12 as shown in FIG. 7. As is apparent from the above description, the deposition of the dielectric planarizing layer 14 can be done after each insulating layer 12 is deposited or can be done periodically to minimize cumulative surface roughness in selected multiply stacked layers of the overall inductor structure.

Once the desired laminate structure is formed, the process can further include deposition of a hard mask onto the laminate structure followed by lithography to complete the device, wherein lithography can then be performed without alignment issues due to wafer bowing.

The inductor including the laminate structure as described can be integrated in a variety of devices. A non-limiting example of inductor integration is a transformer, which can include metal lines (conductors) formed parallel to each other by standard silicon processing techniques directed to forming metal features. The inductor structures can be formed about the parallel metal lines to form a closed magnetic circuit and to provide a large inductance and magnetic coupling among the metal lines. The inclusion of the magnetic material and the substantial or complete enclosure of the metal lines can increase the magnetic coupling between the metal lines and the inductor for a given size of the inductor. Inductors magnetic materials are also useful for RF and wireless circuits as well as power converters and EMI noise reduction.

Figure 8:
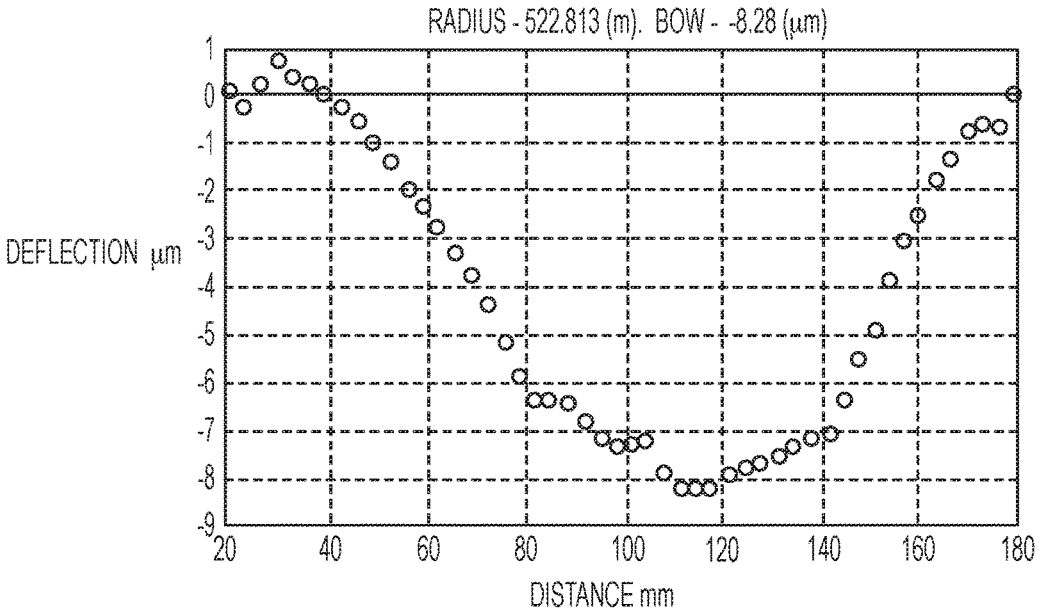
FIG. 8 graphically illustrates deflection as a function of distance of a magnetic inductor structure with stress management.

FIG. 8 graphically illustrates wafer bow in terms of deflection across a wafer including alternating sputtered magnetic film layers having a tensile stress and insulating layers having a compressive stress therebetween deposited thereon in accordance with the present invention at a cumulative thickness of 1200 nm. Wafer bow in the tensile direction across the wafer was about 8 micrometers, which was a marked improvement compared to the magnetic film stack without the compressive insulating layers (see FIG. 1, wherein wafer bow for a magnetic film at a cumulative thickness of only 800 nm was 135 micrometers).

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one more other features, integers, steps, operations, element components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form described. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated It should be apparent that there can be many variations to this diagram or the steps (or operations) described herein without departing from the spirit of the invention. For instance, the steps can be performed in a differing order or steps can be added, deleted or modified. All of these variations are considered a part of the claimed invention.

While the preferred embodiment to the invention had been described, it will be understood that those skilled in the art, both now and in the future, can make various improvements and enhancements which fall within the scope of the claims which follow. These claims should be construed to maintain the proper protection for the invention first described.

What is claimed is:

1. An inductor structure comprising:

one or more metal lines; and a laminated film stack enclosing the one or more metal lines, the laminated film stack comprising a plurality of alternating magnetic layers having a tensile stress and insulating layers having a compressive stress disposed on the magnetic layer, and a dielectric planarizing layer at a thickness of 1 nm to 50 nm on only selected ones of the insulating layers, wherein the dielectric planarizing layer has a neutral stress and a roughness value less than the insulating layer.

2. The inductor structure of claim 1, wherein the dielectric planarizing layer is only on each one of the insulating layers in the laminated film stack.

3. The inductor structure of claim 1, wherein the layers of the magnetic materials have a cumulative thickness greater than 0.8 micrometers.

4. The inductor structure of claim 1, wherein the dielectric planarizing layer is a spin-on or a flowable dielectric material.

5. The inductor structure of claim 1, wherein the dielectric planarizing layer comprises silicate, a siloxane, a methyl silsesquioxane (MSQ), a hydrogen silsesquioxane (HSQ), an MSQ/HSQ, a perhydrosilazane (TCPS), a polysilazane, or a phosphosilicate.

6. The inductor structure of claim 1, wherein the magnetic layers have a tensile stress value in a range from 50 to 400 megapascals.

7. The inductor structure of claim 1, wherein the magnetic material is selected from the group consisting of CoFe, CoFeB, CoZrTi, CoZrTa, CoZr, CoZrNb, CoZrMo, CoTi, CoNb, CoHf, CoW, FeCoN, FeCoAlN, CoP, FeCoP, CoPW, CoBW, CoPBW, FeTaN, FeCoBSi, FeNi, CoFeHfO, CoFeSiO, CoZrO, CoFeAlO, and combinations thereof.

8. The inductor structure of claim 1, wherein the insulator materials are selected from the group consisting of silicon dioxide, silicon nitride, silicon oxynitride, magnesium oxide, aluminum oxide, and combinations thereof.

9. The inductor structure of claim 1, wherein the insulator material layers have a compressive stress of −50 to −400 megapascals for thicknesses at about one half a thickness for the magnetic material layer.

* * * * *